US006904856B2

(12) United States Patent
Wallace

(10) Patent No.: US 6,904,856 B2
(45) Date of Patent: Jun. 14, 2005

(54) METHOD AND APPARATUS FOR ACCESSING UNDERWATER CABLE OR PIPES

(75) Inventor: Graham Peter Wallace, Essex (GB)

(73) Assignee: Global Marine Systems Limited, Chelmsford Essex (GB)

( * ) Notice: Subject to any disclaimer, the term of this patent is extended or adjusted under 35 U.S.C. 154(b) by 0 days.

(21) Appl. No.: 10/363,580

(22) PCT Filed: Sep. 7, 2001

(86) PCT No.: PCT/GB01/04023

§ 371 (c)(1),
(2), (4) Date: Jul. 24, 2003

(87) PCT Pub. No.: WO02/20908

PCT Pub. Date: Mar. 14, 2002

(65) Prior Publication Data

US 2004/0022585 A1 Feb. 5, 2004

(30) Foreign Application Priority Data

Sep. 7, 2000 (GB) ..... 0022002

(51) Int. Cl.[7] ..... B63C 7/00
(52) U.S. Cl. ..... 114/51; 405/163
(58) Field of Search ..... 114/51; 405/162, 405/163; 37/344

(56) References Cited

U.S. PATENT DOCUMENTS 2,934,033 A * 4/1960 Knights et al. ..... 114/51
3,751,927 A * 8/1973 Perot, Jr. ..... 405/163
3,926,003 A * 12/1975 Norman ..... 405/162
4,352,251 A 10/1982 Sloan
4,479,741 A 10/1984 Berti et al.
4,516,880 A * 5/1985 Martin ..... 405/163
4,596,493 A 6/1986 Tisdale et al.
5,288,172 A * 2/1994 Reuhl ..... 405/163
5,361,855 A 11/1994 Schuermann et al.
5,860,232 A 1/1999 Natenson
5,887,667 A 3/1999 Van Zante et al.
5,944,447 A 8/1999 Wyatt

FOREIGN PATENT DOCUMENTS

| | | |
|---|---|---|
| DE | 4138619 A1 | 7/1992 |
| EP | 0325091 A1 | 7/1989 |
| FR | 2736664 A1 | 1/1997 |
| GB | 2363407 A | 12/2001 |

* cited by examiner

*Primary Examiner*—S. Joseph Morano
*Assistant Examiner*—Lars A. Olson
(74) *Attorney, Agent, or Firm*—Townsend and Townsend and Crew LLP

(57) ABSTRACT

A method and apparatus are provided for accessing a cable or pipe (9) buried underwater in a layer of material (10). The method comprises urging a tool (1) through the layer of material (10) by fluidising the material adjacent the tool (1) such that the tool may be positioned at or adjacent the position of the buried cable or pipe.

12 Claims, 6 Drawing Sheets

METHOD AND APPARATUS FOR ACCESSING UNDERWATER CABLE OR PIPES

FIELD OF THE INVENTION

The present invention relates to a method and apparatus for accessing a cable or pipe buried underwater.

BACKGROUND TO THE INVENTION

There has been a gradual proliferation of undersea cables and pipelines connecting regions or countries separated by water. In particular the worldwide expansion of the telecommunications industry has been largely responsible for the increase in buried underwater cables.

Conventional cables are often buried beneath the seabed at a depth of approximately 1 meter, as this has traditionally provided protection from fishing methods and other environmental effects. The threat from fishing to conventional cable laying is mainly due to trawling "otter" boards which may penetrate the seabed up to a depth of up to 0.5 metres.

The maintenance or repair of such undersea cables is necessary for example to correct faults, repair damage or to replace such devices as fibre-optic cable repeaters.

One known method of recovering buried underwater cables is to drag a grapnel through the seabed from a surface ship. However, this method has a number of associated problems, particularly in that more than one cable may be hooked by the grapnel and retrieved at the same time, and the action of hooking a cable and raising it to the surface may cause the cable to be damaged or even break.

A more preferred method of recovering cables is to expose the cable by excavation of a wide shallow-sided depression in the seabed. This is generally performed using a surface vessel along with an underwater remotely operated vehicle (ROV).

A typical cable recovery operation involves the location of the relevant part of the cable followed by deploying an ROV to a position on the seabed close to the relevant section of the cable.

A standard cable maintenance ROV is equipped with water jets powered by on-board water pumps and these jets are used to excavate the shallow-sided depression. The maximum angle that the walls of the excavated depression may make with the horizontal plane depends upon the type of seabed material being excavated, for example sand or mud. Typically such an angle lies within the range 30° to 45°.

The excavation is performed until the relevant area of the cable is exposed at the bottom of the depression. The ROV rests at the perimeter of the depression and a manipulator arm attached to the ROV is then extended into the depression such that its remote end is positioned adjacent the cable.

A hydraulic cutter attached to the remote end of the manipulator arm is then used to sever the cable. A "gripper" having a lifting line attached to the surface vessel, is then attached to one severed end of the cable using the manipulator arm. The ROV then moves away and the cable is pulled to the surface using the line and a winch.

The ROV may also attach a pinger to the other severed end of the cable such that this may be easily located later and also raised to the surface.

Although this conventional method has proved successful for cables buried to around 1 meter, it has been found recently that some new fishing methods, employed mainly in the Far East, will now penetrate a soft seabed to a depth of around 2 metres. This of course places conventionally buried (1 meter depth) cables in danger of damage during fishing. One implemented solution to this problem is to bury the cables deeper within the seabed and the burial depth in some regions is now between 3 and 4 metres.

However, conventionally equipped ROVs are designed to locate and excavate cables buried only to a depth of around 1 meter, in addition to performing cutting operations and attaching recovery grippers. Such ROVs are also capable of reburying the cables to a similar depth of 1 meter.

Standard cable recovery ROVs have a typical power supply of about 200 horsepower which is used by the on-board systems such as upwardly directed thrusters (to increase the ROV's effective weight), manoeuvring thrusters, hydraulics to power a manipulator arm and water jet pumps.

Cables buried at greater depths cause a serious problem in that a much larger excavated depression is required such that the sides of the depression are maintained at the acceptable angle in order to prevent the sides caving in. Conventional ROVs have insufficient power to excavate such large depressions in a reasonable time and the design and construction of new more powerful ROVs capable of performing this task is extremely undesirable economically.

SUMMARY OF THE INVENTION

In accordance with a first aspect of the present invention, we provide a method of accessing a cable or pipe buried underwater in a layer of material, the method comprising:

urging a tool through the layer of material by fluidising the material adjacent the tool such that the tool may be positioned at or adjacent the position of the buried cable or pipe.

The present invention addresses the problems caused by the deeper burial of cables by providing a novel method of accessing the cables. Rather than excavating a shallow-sided depression, the tool of the present invention is arranged to pass through the material layer by using the power of the ROV in a localized manner to fluidise the region of the material adjacent the tool. In this way the conventional power source of an ROV may be used to access a buried cable or pipe despite their greater buried depth.

The possible use of a standard ROV also advantageously reduces the cost of modifying the equipment.

The method of the present invention is suitable for in situ maintenance or repair of cables or pipes buried within the material as well as for forming part of a modified lifting operation for retrieval as described more fully below.

In principle the method of the present invention may therefore be used to access buried cables or pipes at any depth within the material, including those buried at the conventional depth of around 1 meter.

The fluidising of the material may be achieved by a suction method in which the removal of fluidised material from a region adjacent the tool causes further fluidising by an ingress of water to the region. Alternatively a water jet may be used to direct water at the material and cause it to be fluidised. Each of these methods may also be used in combination.

In general, the tool will be urged through the material along a substantially rectilinear path although the tool may also be arranged to be steerable.

The method may typically further comprise maintaining a fluidised layer of material around the tool either when the tool is positioned within the material or when the tool is being urged through the material. This is particularly advantageous because when the fluidising action is terminated many types of typical seabed material set in a very rigid manner. Furthermore, fluidising a layer around the tool reduces the forces upon the tool caused by steering along a non-rectilinear path.

Preferably the method further comprises locating the cable or pipe using a locator device, where the tool is moved through the material in response to a signal produced by the locator device. In this way, accurate positioning of the tool may be achieved by guiding the tool in response to the signal. The locator device may be attached either to the tool itself, or independently to the ROV. A suitable locator device is a magnetometer.

In many cases, it will be desirable to remove the cable or pipe from its buried position to the surface of the seabed or on to the deck of a surface ship where maintenance or repair operations may be more easily performed. The method may therefore further comprise lifting the cable or pipe using a lifting device such that at least part of the cable or pipe is lifted to a position at or adjacent an upper surface of the material.

Typically this will involve raising it to the top of the seabed by attaching a lifting device to the cable or pipe, the other end of which is attached to a vessel such as a ship. The power of the vessel may then be used to provide the force to lift the cable or pipe through the material.

The cable or pipe may then be severed and lifted to the surface vessel in a conventional manner.

As the cable or pipe may be buried under approximately 3 to 4 metres of material, the material above it may cause significant resistance to the movement of the cable or pipe during a lifting operation. In order to reduce this, the method may further comprise fluidising at least the part of the material layer adjacent the upper surface of the material such that the material layer is softened. The force required to lift the cable or pipe through the material layer is therefore reduced. Typically such a fluidising method will be performed along the seabed in a direction following the cable or pipe.

In accordance with a second aspect of the present invention, we provide apparatus for accessing a cable or pipe buried underwater in a layer of material, the apparatus comprising:

a tool for accessing the cable or pipe; and at least one fluidising device arranged to fluidise the material adjacent the tool such that the tool may be urged through the material layer and positioned at or adjacent the position of the buried cable or pipe.

The fluidising device may be used in a second way as a propulsion device to urge the tool, for example when the fluidising device comprises water jets. However, preferably the apparatus will further comprise at least one urging device for urging the tool through the material layer. Typically, this may be achieved using hydraulics or any other suitable drive mechanism for forcing the tool through the material layer.

In general the fluidising device will have at least one conduit having at least one opening arranged to either deliver water to a region adjacent the tool so as to fluidise material; or to remove fluidised material from the region adjacent the tool. The conduit may be constructed from hoses or pipes attached to the tool. Preferably the conduit will be formed as part of the structure of the tool, for example within the tool housing such as an internal bore.

The fluidising device may further comprise at least one nozzle which takes the form of an opening communicating with the conduit. Other forms of nozzle may be arranged to be steerable. A number of nozzles may be provided for each conduit and in general the fluidising device will be positioned at least at the foremost end of the tool with respect to an urging direction.

In addition, the fluidising device may have a number of conduit openings arranged along the length of the tool so as to maintain a layer of fluidised material around the tool. Appropriate conduits and nozzles may be used for this purpose.

Preferably when the one or more first conduits are provided to deliver water to the region adjacent the tool as one or more first conduits, the fluidising device will also have one or more second conduits arranged to remove fluidised material from the region adjacent the tool.

In this case the first and second conduits are preferably arranged as an eductor having a number of ducts internally connecting the first and second conduits. These ducts divert part of the water supplied through the first conduit(s) into the second conduit(s) thereby causing the ingress of fluidised material through the second conduit(s).

The tool may comprise a jointed manipulator arm. Alternatively a rod or tube could equally be used as a fluidising lance.

The use of a jointed manipulator arm conveniently provides a method of steering the tool by controlling the action of each joint for example using hydraulics. The joints may be arranged to allow movement about a number of axes.

Alternatively, a lance provides advantages in that the use of complicated joints is largely avoided. Lateral manoeuvreability can be provided by moving the ROV to which the lance is attached whilst the lance is positioned in the material. This may be aided by fluidising the layer of material around the buried part of the lance.

When the tool is an elongate lance, the urging device may be arranged to rotate the lance about an axis substantially perpendicular to the elongate direction of the lance, between a storage position and an operation position.

Typically the tool will also include a manipulating device capable of manipulating other devices such as the lifting device, a gripper or a cutting device. The manipulating device may also be used for clasping the cable or pipe.

BRIEF DESCRIPTION OF THE DRAWINGS

Some examples of methods and apparatus for accessing a buried underwater cable or pipe will now be described with reference to the accompanying drawings, in which.

DETAILED DESCRIPTION OF THE EXAMPLES

Figure 1:
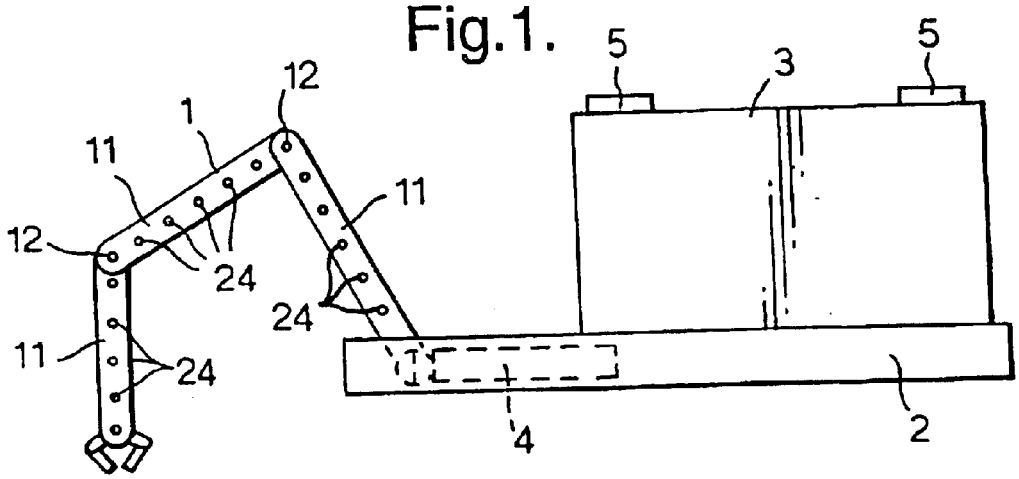
FIG. 1 is a schematic side view partly in section of a remotely operated vehicle according to a first example.

FIG. 1 shows a remotely operated vehicle (ROV) having a jointed manipulator arm 1 attached to a tool skid 2 and a power source 3 supported on the tool skid 2. The manipulator arm 1 comprises a number of jointed sections 11 each pivoted about pivot points 12. The power source 3 typically comprises a motor of approximately 200 horsepower which acts as a power source for the manipulator arm 1 operated by a hydraulic system 4. A number of thrusters 5 are also provided in order to increase the effective weight of the ROV by providing a downwards force.

Figure 2:
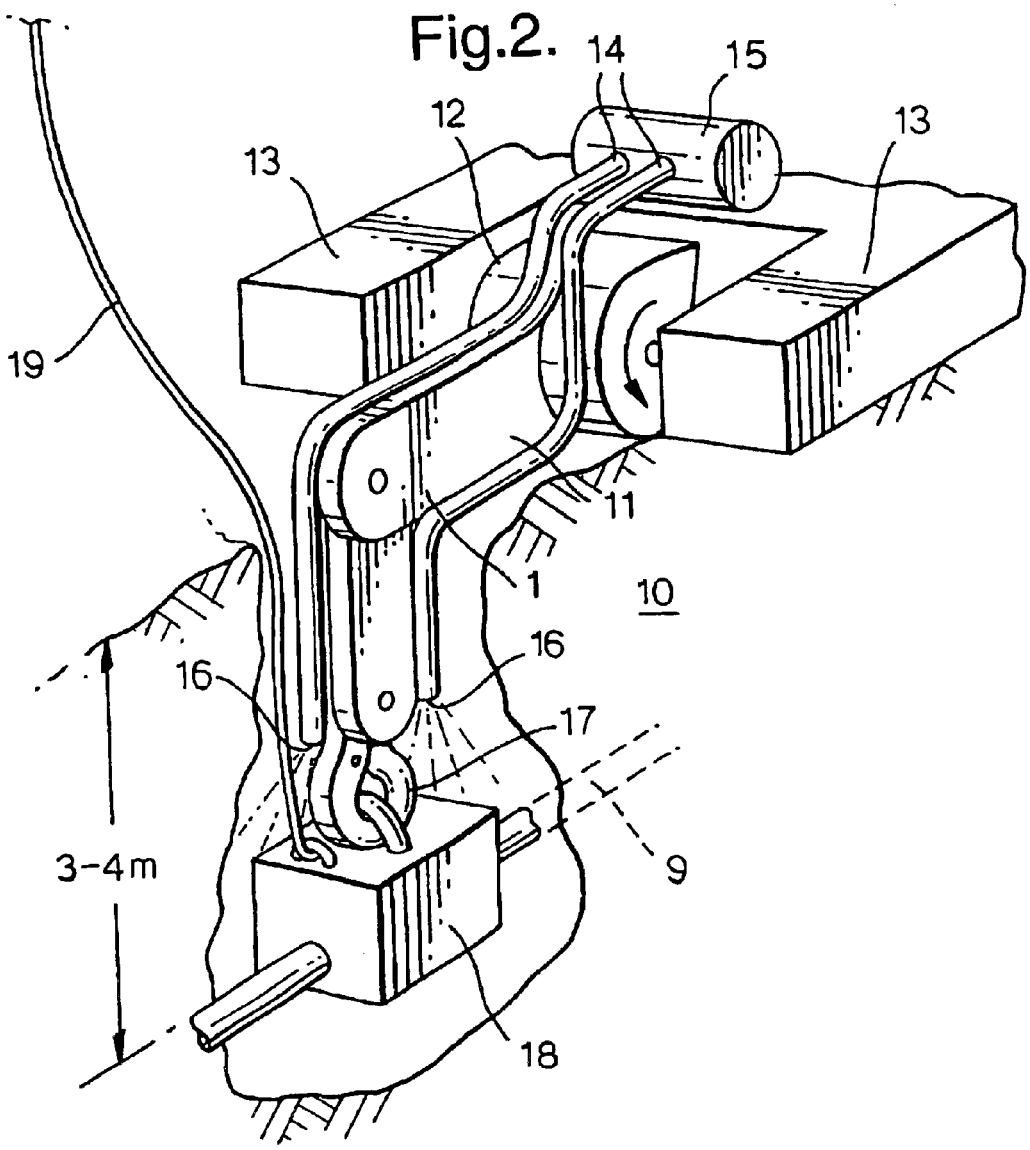
FIG. 2 illustrates the access of a buried cable according to the first example.

FIG. 2 shows the use of the manipulator arm 1 in accessing a cable 9 buried 3 to 4 metres into the seabed generally indicated at 10.

The length of the jointed manipulator arm 1 is such that the remote end of the manipulator arm can comfortably reach a cable buried at such a depth whilst the ROV is positioned upon the surface of the seabed 10.

As shown in FIG. 2, the section of the manipulator arm 11 attached to the ROV is connected via a rotatable joint 12 which may be rotated through an angle of approximately 180°.

A front end of the tool skid 2 has two projecting arms 13 between which the joint 12 of the manipulator arm is mounted.

Control circuitry and hydraulic connections (not shown) are provided to the manipulator arm through the joint 12. These allow each of the jointed sections of the manipulator arm 1 to be moved individually.

Two flexible hoses 14 are connected to a water manifold 15 attached to the ROV which is supplied with water from water pumps within the ROV. The water is pumped through the manifold 15 along the hoses 14. The hoses 14 are positioned along the manipulator arm 1 and are attached to it at a number of points such that they follow the movement of the manipulator arm during use.

Each hose 14 in FIG. 2 terminates in an opening 16 such that water exiting the hoses is directed along a line substantially parallel to the long axis of the end most section of the manipulator arm 11.

The water pumped along the hoses and out of the openings 16 fluidises the region surrounding the end of the manipulator arm 1.

The manipulator arm of the present example is also equipped with a mechanical claw 17 which may be opened and closed hydraulically. In FIG. 2, the claw 17 is grasping a lifting device 18 which is releasably fitted around the cable 9 by the manipulator arm. FIG. 2 represents the position reached by the manipulator arm 1 following the penetration of the seabed 10 by operation of the hydraulics in accordance with the fluidising of the seabed around the end of the tool. This is achieved whilst the claw 17 holds the lifting device 18.

One end of a lifting line 19 is attached to the lifting device 18 whilst the other end is connected to a winch aboard a surface vessel. Following attachment of the lifting device 18, the lifting line 19 is used to raise the cable to the surf ace of the seabed where it may be dealt with in a conventional manner.

Figure 3:
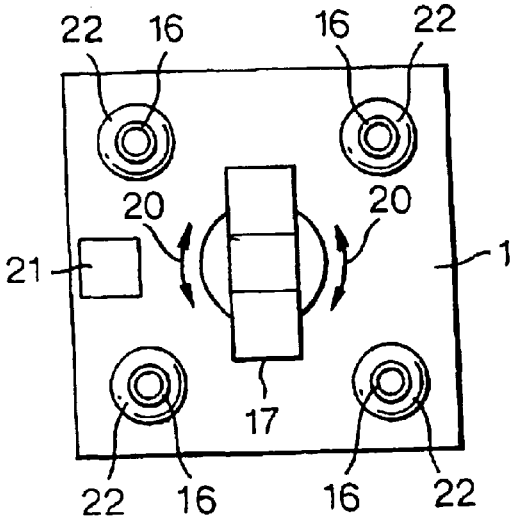
FIG. 3 is a schematic view of the end of the manipulator arm according to a second example.

FIG. 3 shows a second example of a manipulator arm 1 as viewed from the remote end. As in the previous example, a mechanical claw 17 is provided at the end of the manipulator arm and in this case the claw is also rotatable about the long axis of the manipulator arm section, as indicated by the arrows 20. In this example a magnetometer 21 is also fitted to the end of the manipulator arm 1 to act as a locator device for locating the cable. This is particularly useful as the movement of the seabed material reduces visibility for any remotely operated cameras.

A number of primary nozzles 22 are also indicated in FIG. 3 positioned substantially at the corners of the endmost section of the manipulator arm 1 as viewed from the claw end. In this example the hoses 14 have been replaced by internal conduits within the manipulator arm, the conduits terminate in openings 16 in the form of the nozzles 22.

In the present example, water is jetted from the nozzles 22 and each of the nozzles 22 is steerable to allow greater control during fluidising.

Figure 4:
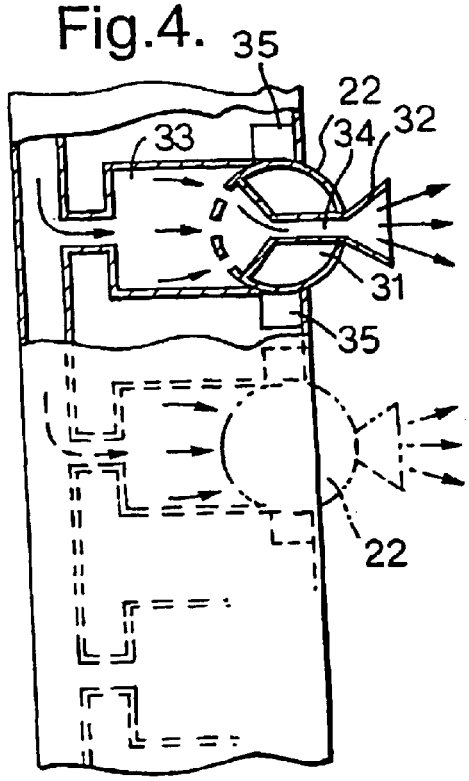
FIG. 4 is a section through one part of a manipulator arm showing an internal conduit and nozzle arrangement.

FIG. 4 shows the arrangement of the nozzles more clearly. In this case, in addition to the primary nozzles, a number of secondary nozzles are arranged along the length of the manipulator arm, for example at points 24 as indicated on FIG. 1. These provide the manipulator arm with the ability to maintain a layer of fluidised material around itself.

The primary and secondary nozzles are each connected to a conduit 13 positioned within the body of the arm 1. In this case each nozzle 22 is formed from a partly spherical section 31 and an external funnel 32. Behind the partly spherical portion 31 lies a chamber 33 connected to the conduit 30. A channel 34 connects the chamber 33 to the funnel 32 such that water from the conduit 30 may pass through the chamber 33 and out through the funnel 32 via the channel 34 in order to fluidise the material 10.

Each nozzle, and in particular the primary nozzles may also be steerable by four motors 35 positioned in a cross formation around each nozzle. This can be achieved using gears for each motor arranged to mesh with suitably arranged racks on the spherical portion 31.

Alternatively the secondary nozzles may be static and directed substantially normal to the surface of the manipulator arm.

Figure 5:
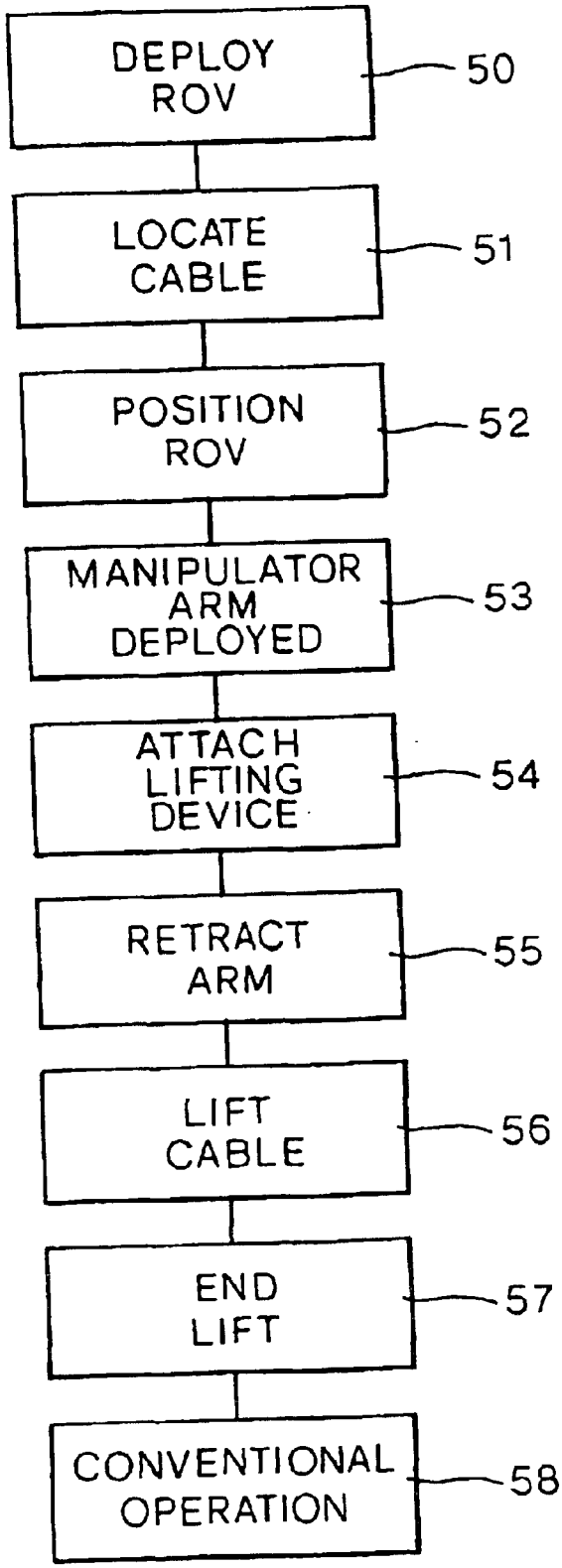
FIG. 5 is a flow chart of a cable recovery method according to the first and second examples.

A method of operating the apparatus described in the examples above for the location, access and retrieval of a buried undersea cable will now be described in association with FIG. 5.

An ROV equipped with apparatus as described above, is deployed in the vicinity of a cable fault at step 50. The cable in question is then located electronically for example using magnetometers either attached to the manipulator arm, the ROV body or to a separate ROV at step 51. The ROV is then positioned on the seabed above the cable at step 52 and the thrusters 5 are operated in order to increase the effective weight of the ROV during the subsequent fluidising operation. Whether or not the use of thrusters is actually necessary is dependent upon the weight of the ROV.

The manipulator arm is then deployed at step 53. This involves the forcing of the manipulator arm through the seabed 10 hydraulically, whilst at the same time fluidising the surrounding material using the hoses 14. The increased effective weight provides a reaction force to the hydraulic movement of the manipulator arm.

In this example, the ROV pumps force water under high relative pressure into the manifold 15 and along the hoses 14 to exit the hoses at the opening 16. The interaction of the high pressure water with the material 10 adjacent the remote end of the manipulator arm causes the material to be fluidised and displaced such that the manipulator arm may move through the material.

In systems with steerable manipulator arms having joints rotatable about more than one axis, the steering may cause part of the manipulator arm along its length to impact against the sides of the fluidised hole created by the jets. In this case, the use of additional fluidising nozzles at positions 24 is desirable.

The remote end of the manipulating arm 1 is brought into close proximity with the cable 9 and may be finally positioned using the magnetometer 21 during step 53.

During the descent of the manipulator arm through the material 10, the mechanical claw 17 holds a cable lifting device which may be a gripper 18 or simply a hook which may be hooked upon the cable. The lifting device with its associated lifting line 19 is then attached to the cable at step 54.

The manipulating arm is then retracted at step 55 and the thrusters 5 are turned off such that the ROV can be directed away from the location.

Once the ROV is clear of the location, the cable may be lifted slowly towards the surface of the material 10 using the line 19 from the surface vessel at step 56. At a convenient time before the lifting, the seabed above the cable may be softened by a fluidising operation using one or more conventional ROVs.

When the cable has been brought to the surface of the seabed 10, the lifting is terminated at step 57. At this point the cable can then be treated as in a conventional cable recovery operation in which the cable is cut and the individual ends are brought consecutively onto the surface vessel for appropriate repair or maintenance. This is shown generally at step 58 in FIG. 5.

Figure 6:
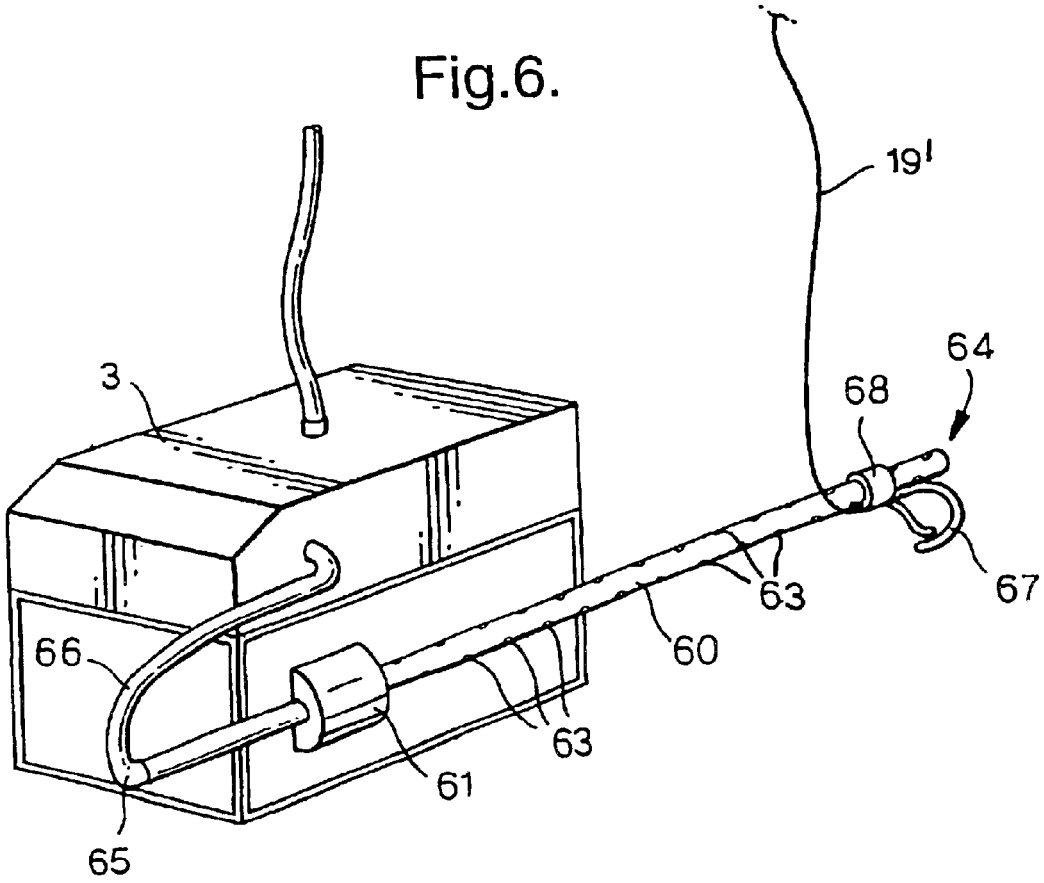
FIG. 6 is an illustration of a remotely operated vehicle according to a third example.
Figure 7:
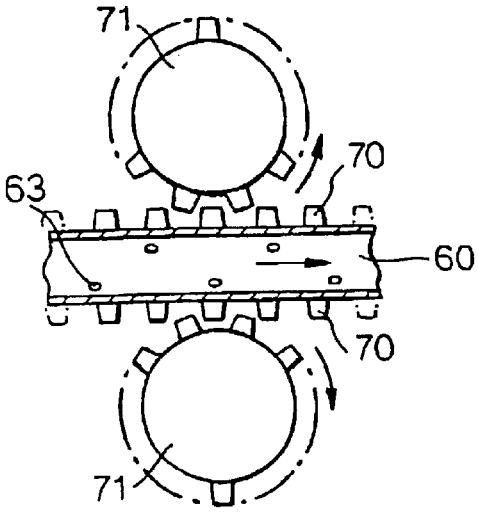
FIG. 7 shows the drive mechanism for the lance of the third example.
Figure 8:
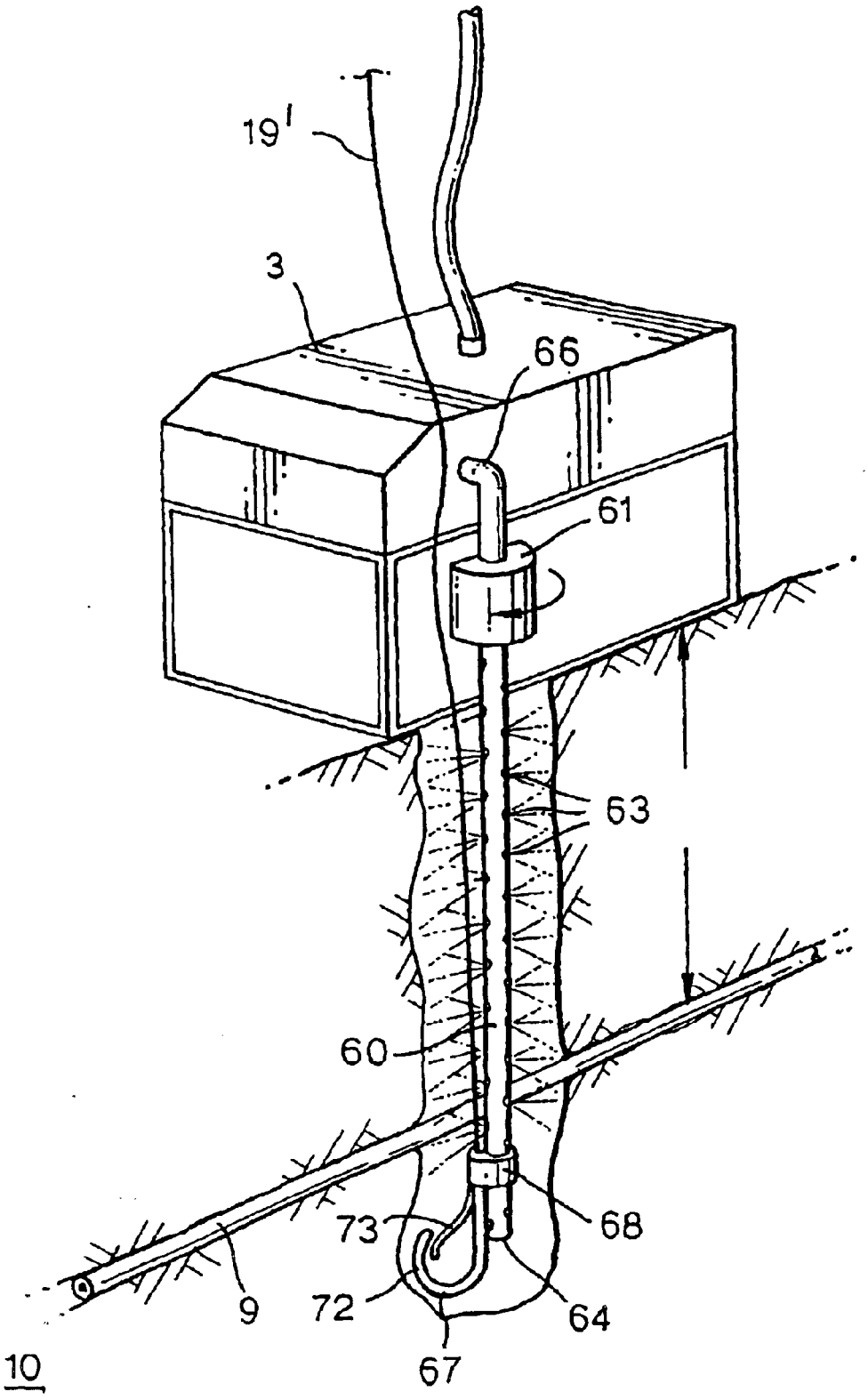
FIG. 8 shows the access of a buried cable according to the third example.

A third example is shown in FIGS. 6 to 8. In this case the manipulator arm 1 is replaced by an elongate fluidising lance 60 which is attached to the side of the ROV 3 using a rotatable drive mechanism 61. The lance 60 is arranged to be substantially rigid and may be constructed from an appropriate metal such as stainless steel.

The drive mechanism 61 is arranged to be rotatable with respect to the ROV such that the lance 60 can be rotated between a substantially horizontal storage position and a substantially vertical operation position for fluidising the seabed.

FIG. 6 shows the lance when stored in the horizontal storage position. The lance 60 has an internal hollow bore running along its length. A number of jetting openings 63 are arranged at locations around and along the length of the lance. These connect the internal bore to the external environment. In addition, the bore passes through an open end 64 of the lance for use in penetrating the seabed. The other end of the lance 65 is connected to the ROV using a flexible hose 66.

In this example the hose is arranged to retract into the ROV body, ensuring that only a suitable length is reeled out due to the movement of the lance end 65. The hose 66 connects the lance to an internal manifold which is supplied with water using the water pumps of the ROV.

Adjacent to the open end 64, a hook 67 is releasably attached to the lance 60 with an attachment member 68. The hook 67 comprises a substantially U-shaped section and a deflectable member which is urged towards a position to close the open side of the hook. This allows the cable 9 to be securely retained once positioned within the hook 67.

As in the previous example, one end of a lifting line 19' is attached to the hook 67, the other end being attached to a surface vessel.

The drive mechanism 61 is arranged not only to attach the lance 60 to the ROV and rotate it about an axis perpendicular to its elongate direction, it is also provided with means to move the lance 60 to and fro in a direction parallel to this elongate direction. This is achieved using a double rack and pinion mechanism as shown in FIG. 7. Two flat gear racks 70 are attached to opposing sides of the lance and are meshed with two pinions 71 within the drive mechanism 61, powered by a suitable motor. Similarly, smooth pinch rollers or hydraulic actuators could be used for this purpose.

Returning to FIG. 6, the lance is shown as arranged in its horizontal storage position. This position is suitable for deploying the ROV and manoeuvering it underwater when not in contact with the seabed. The horizontal storage position allows the ROV to be landed upon the seabed easily.

Once the ROV is in position upon the seabed, the drive mechanism 61 is operated such that the end of the lance 64 is moved towards the drive mechanism 61. As this extends the second end 65 away from the drive mechanism, the hose 66 is reeled out of the ROV housing.

The range of possible movement of the lance 60 along its elongate axis is arranged such that the minimum distance between the drive mechanism 61 and the end 64 is less than that between the drive mechanism 61 and the seabed 10. This ensures that the end 64 does not impact against the seabed upon subsequent rotation of the lance.

Following rotation of the lance into a substantially vertical position, the water pumps are operated to force water through the pipe 66 and along the lance 60 to jet out of the openings 63 and the end opening 64. Any surrounding seabed material is therefore fluidised.

The pinions 71 of the drive carriage 61 are then rotated to gradually force the lance 60 into the seabed and its passage is enabled by the fluidising process. Again, alternatively pinch rollers or hydraulic actuators could be used to achieve this.

Once the lance has reached the required depth (3 metres in this example) it is locked into position and the hook 67 is attached to the cable 9. The hook is then released from the attachment member 68 and the lance is withdrawn. When the ROV has been moved to a safe distance, the cable is then lifted using the lifting line 19' to the surface of the seabed.

It may be difficult to correctly position the ROV above the cable 9. However, because the lance is substantially rigid, lateral movement of the lance 60 within the seabed can be achieved by physically moving the ROV. This can be achieved using the conventional thruster systems of the ROV allowing a lateral search to be made for the cable 9. The provision of the openings 63 along the length of the lance 60 ensures that the material surrounding the part of it within the seabed is fluidised.

For accurate final positioning of the hook 67, in addition to the provision of a magnetometer adjacent the lance end 64, the attachment member 68 may be arranged to be moveable for example around and along the lance. The cable 9 may therefore be hooked by the combined movements of the attachment member 68 and the drive mechanism 61.

Figure 10:
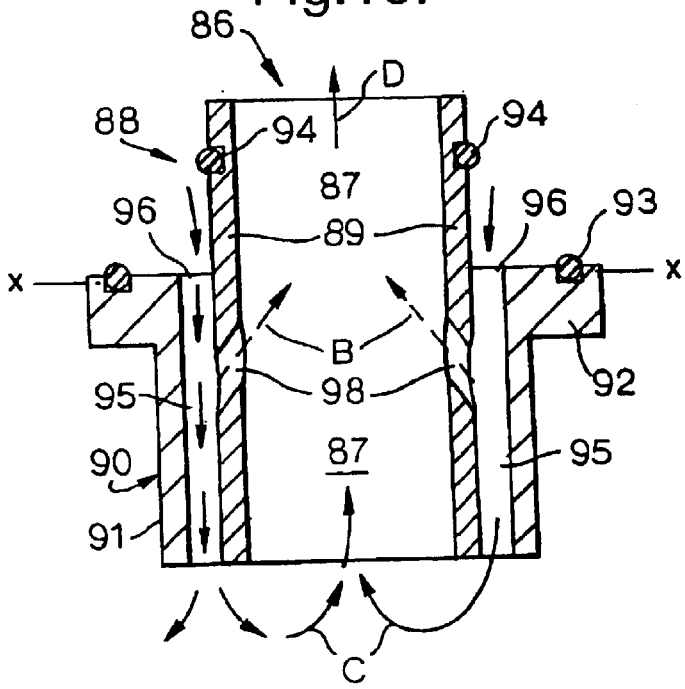
FIG. 10 shows the eductor of the fourth example, partly in section.
Figure 11:
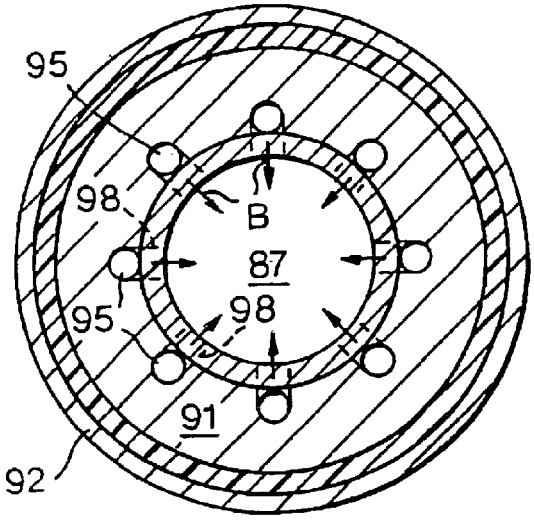
FIG. 11 shows the eductor, partly in section, when sectioned along the line X–X' in FIG. 10.
Figure 9:
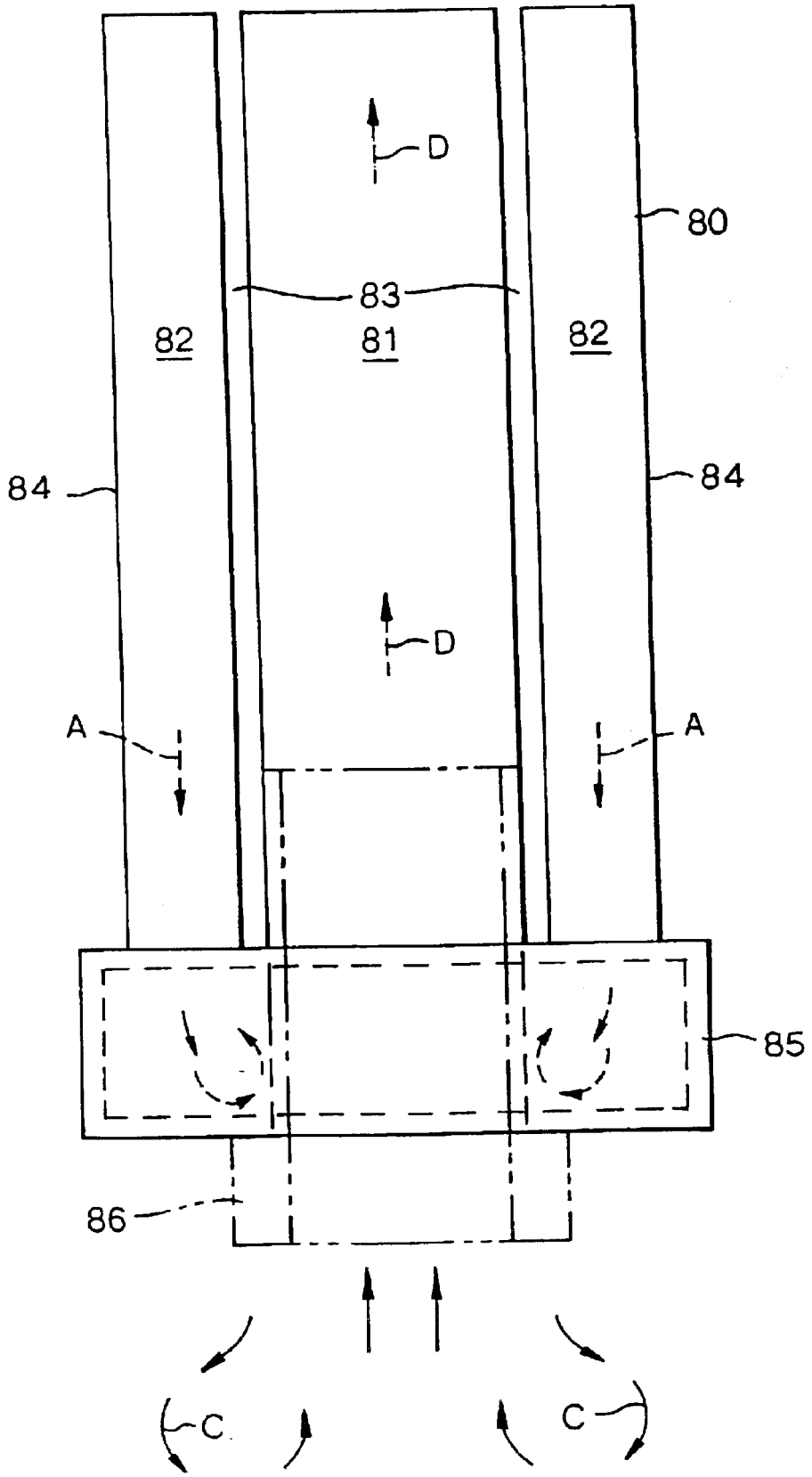
FIG. 9 is an illustration, partly in section, of a lance and eductor according to a fourth example.

FIGS. 9 to 11 illustrate an alternative example of a lance 80. This may be used in a similar manner to the lance 60 of the third example described above, with a similar drive mechanism and attachment member. In this particular example, a magnetometer is not fitted to the lance 80, although a magnetometer is provided by a separate attachment to the ROV.

As shown in FIG. 9, the lance 80 is arranged as three parallel tubes of circular cross-section. These comprise a central tube 81 having an internal bore, flanked on either side by two outer tubes 82 each having an internal bore. The diameter of the central tube 81 is about 100 mm. The tubes 82 may be separate or attached to the sides of the central tube along their length as indicated at 83. The wall of the central tube and the walls 84 of the outer tubes 82 may each be formed from an alloy such as stainless steel. Alternatively, the outer tubes 82 may take the form of flexible hoses in a similar manner to the hoses 14 of the first example.

At the lower end of the lance 80, the outer tubes 82 extend beyond the inner wall 83 and connect to an annular manifold 85 as indicated in FIG. 9.

Referring to FIG. 10, a detachable eductor 86 constructed from a plastics material, is arranged to attach to the annular manifold 85 to enhance the effectiveness of the lance 80 in removing the sea bed material.

The eductor 86 has an inner circular bore 87 passing completely through it and having a similar cross section to the bore of the central tube 81 of the lance 80. In an upper section 88 of the eductor 86, the bore 87 is bounded by an upper eductor wall 89, whereas in a lower section 90 of the eductor 86, the bore 87 is bounded by a thicker lower eductor wall 91.

A flange 92 is provided at the upper end of the lower section 90, the flange having a larger diameter than the lower eductor wall 91. The eductor 86 is attached to the lance 80 at the manifold 85, using the flange 92 and the upper eductor wall 89, each of which are provided with seals 93,94.

Within the lower eductor wall 91, eight tubes 95 are circumferentially positioned parallel to the bore 87, each having an upper end opening 96 upon the upper surface of the flange (within the manifold 85), and a lower end 97 opening on the underside of the eductor 86 adjacent the opening of the bore 87. Two of these tubes are shown in FIG. 10.

Within each tube, a duct 98 connects the tube 95 to the inner bore of the eductor 86. As shown in FIG. 10, each duct 98 is angled upwardly at about 70 degrees of angle, so that the openings of the ducts 98 on the inner surface of the lower eductor wall 91 are displaced upwards with respect the opening of the ducts 98 in the tube 95. This almost fully reverses the direction of any water flowing down the tubes 95 which enters the ducts 98.

FIG. 11 shows a section through the eductor 86 along a line X–X' in FIG. 10. The tubes 95 and ducts 98 are shown circumferentially spaced around the lower eductor wall 91.

One distinction between this fourth example and the third example, is that water is not only pumped from the ROV to fluidise the bed material through the tubes 92 and 95, but is also removed from the region surrounding the lance 80 through the bore 87 and via the central tube 81. The action of the ducts 98 causes the fluidised material to be jetted up the bore 87. An additional pump aboard the ROV could also be used to remove this material.

As in the third example, additional nozzles may be provided along the length of the lance 80 to ensure that the material surrounding the lance 80 is fluidised.

The eductor 86 described in this example can be fitted to the apparatus described in connection with the first, second and third examples, provided that at least one conduit is supplied to deliver the water to the eductor 86, and a second conduit is also supplied to remove the fluidised material.

Returning to FIGS. 9 to 11, in use the detachable eductor 86 is fitted to the manifold 85 of the lance 80. Water from the ROV manifold is pumped down the outer tubes 82 of the lance 80 towards the manifold 85 as indicated by the arrows A (FIG. 9). The water then enters the tubes 95 through the openings in the flange 92, and is jetted out of the lower end of the eductor 86 to fluidise the sea bed material. Some of the water is also diverted upwards into the bore 87 through the ducts 98 as indicated by the arrows B. This causes the suction effect of the eductor 86 by encouraging material to be drawn into the bore 87.

This generates an overall induced flow indicated by the arrows C (FIGS. 9,10) beneath the eductor 86, where the fluidised bed material is removed. This material is then drawn upwards through the bore in a direction indicated by the arrows D.

A substantially similar method to that described in association with the first and second examples for accessing and recovering a cable may therefore also be used with the lances 60, 80 of the third and fourth examples respectively.

What is claimed is:

1. Apparatus for accessing a cable or pipe (9) buried underwater in a layer of material (10), the apparatus comprising:

a tool (1) for accessing the cable or pipe; and at least one fluidising device arranged to fluidise the material (10) adjacent the tool such that the tool (1) may be urged through the material layer (10) and positioned at or adjacent the position of the buried cable or pipe (9); wherein the fluidising device comprises a conduit (14) having at least one opening (16) arranged to either deliver water to a region adjacent the tool so as to fluidise the material (10); or remove fluidised material from the region adjacent the tool (1);

the fluidising device has one or more first conduits (82, 95) arranged to deliver water to the region adjacent the tool, and wherein the fluidising device further comprises one or more second conduits (81) arranged to remove fluidised material from the region adjacent the tool; and the one or more first conduits (82, 95) and second conduits (81) are arranged as an eductor (86), having a number of ducts (98) internally connecting the first and second conduits such that part of the water supplied through the one or more first conduits is diverted into the second conduit, thereby causing the ingress of fluidised material through the second conduit (81).

2. Apparatus for accessing a cable or pipe (9) buried underwater in a layer of material (10), the apparatus comprising:

a tool (1) for accessing the cable or pipe wherein the tool (1) comprises a jointed arm; and at least one fluidising device arranged to fluidise the material (10) adjacent the tool such that the tool (1) may be urged through the material layer (10) and positioned at or adjacent the position of the buried cable or pipe (9).

3. Apparatus for accessing a cable or pipe (9) buried underwater in a layer of material (10), the apparatus comprising:

a tool (1) for accessing the cable or pipe wherein the tool is an elongate rod or tube forming a lance (60, 80);

at least one urging device for urging the tool through the material layer (10); and at least one fluidising device arranged to fluidise the material (10) adjacent the tool such that the tool (1) may be urged through the material layer (10) and positioned at or adjacent the position of the buried cable or pipe (9);

wherein the urging device (61) is arranged to rotate the lance (60, 80) about an axis substantially perpendicular to the elongate axis of the rod or tube between a storage position and an operation position.

4. Apparatus according to claim 1 or 2 or 3, further comprising at least one urging device for urging the tool through the material layer (10).

5. Apparatus according to claim 1 or 2 or 3, wherein the fluidising device conduit (30) is formed from the structure of the tool.

6. Apparatus according to claim 1 or 2 or 3, wherein the fluidising device has at least one steerable nozzle (22).

7. Apparatus according to claim 1 or 2 or 3, wherein the fluidising device is positioned at a foremost end of the tool with respect to an urging direction.

8. Apparatus according to claim 1 or 2 or 3, wherein the fluidising device has a number of conduit openings (22) arranged along the length of the tool so as to maintain a layer of fluidised material around the tool (1) either when the tool is positioned within the material (10) or when the tool is being urged through the material (10).

9. Apparatus according to claim 1 or 2 or 3, further comprising a locator device (21) attached to the tool wherein the locator device (21) is arranged to produce a signal indicating the location of the cable or pipe (9) such that the tool (1) may be guided to the location.

10. Apparatus according to claim 9, wherein the locator device (21) is a magnetometer.

11. Apparatus according to claim 1 or 2 or 3, further comprising a lifting device (18, 19) which may be attached to the cable or pipe (9) using the tool (1).

12. An underwater vehicle comprising apparatus according to claim 1 or 2 or 3.

* * * * *